US005851012A

United States Patent [19]

Langieri, Jr. et al.

[11] Patent Number: 5,851,012

[45] Date of Patent: Dec. 22, 1998

[54] BALL GAME APPARATUS WITH SPIN IMPARTING CATAPULT

[75] Inventors: Michael Langieri, Jr., Long Meadow; Stephen M. Langieri, Springfield, both of Mass.

[73] Assignee: Rare Toys and Games, Inc., Enfield, Conn.

[21] Appl. No.: 886,200

[22] Filed: Jul. 1, 1997

[51] Int. Cl.[6] ..... A63F 7/20

[52] U.S. Cl. ..... 273/317.1; 273/317.5; 273/108.53; 273/108.56

[58] Field of Search ..... 273/317.3, 317.1, 273/317.7, 108.52, 108.54, 108.51, 108.53, 108.55, 108.56, 119 R, 126 R, 126 A, 129 V, 129 W, 129 S, 317.5, 108.1; 124/8, 9, 36, 43, 50; 221/238, 289, 290

[56] References Cited

U.S. PATENT DOCUMENTS

| | | | |
|---|---|---|---|
| 1,162,140 | 11/1915 | Cusick . | |
| 1,557,834 | 10/1925 | Hassig . | |
| 1,617,546 | 2/1927 | Schmid . | |
| 2,192,096 | 2/1940 | Minger . | |
| 2,203,990 | 6/1940 | Heymer . | |
| 2,421,220 | 5/1947 | Robinson, II et al. . | |
| 2,433,224 | 12/1947 | Koci . | |
| 2,658,495 | 11/1953 | Elliott, Sr. . | |
| 2,720,397 | 10/1955 | Blanton . | |
| 2,734,745 | 2/1956 | Tarte, Jr. . | |
| 2,735,682 | 2/1956 | Sweet . | |
| 2,783,754 | 3/1957 | Heiss . | |
| 2,886,321 | 5/1959 | Tarte, Jr. . | |
| 2,893,734 | 7/1959 | Tarte, Jr. . | |
| 2,980,095 | 4/1961 | Hoag . | |
| 3,063,161 | 11/1962 | Baranoff . | |
| 3,531,120 | 9/1970 | Ross et al. . | |
| 3,601,402 | 8/1971 | Kohner et al. . | |
| 3,610,623 | 10/1971 | Ferrer . | |
| 3,635,204 | 1/1972 | Plumb . | |
| 3,817,529 | 6/1974 | Dobbins | 273/126 R |
| 3,865,373 | 2/1975 | Knight . | |
| 3,888,485 | 6/1975 | Conti . | |
| 3,899,173 | 8/1975 | Zaris . | |
| 3,958,806 | 5/1976 | Brown . | |
| 4,013,292 | 3/1977 | Cohen et al. . | |
| 4,088,322 | 5/1978 | Nikoden, Jr. . | |
| 4,109,914 | 8/1978 | Matsumoto . | |
| 4,177,992 | 12/1979 | Todokoro . | |
| 4,239,214 | 12/1980 | Brenner . | |
| 4,437,664 | 3/1984 | Wiczer | 273/121 A |
| 4,480,834 | 11/1984 | Minami | 273/128 R X |
| 4,496,160 | 1/1985 | Wichinsky et al. . | |
| 4,858,920 | 8/1989 | Best . | |
| 5,029,862 | 7/1991 | Driska | 273/119 R |
| 5,035,423 | 7/1991 | Arciniega . | |
| 5,074,552 | 12/1991 | Gomez et al. . | |
| 5,150,898 | 9/1992 | Hochberg et al. . | |
| 5,257,780 | 11/1993 | Cook et al. . | |
| 5,330,175 | 7/1994 | Kim . | |
| 5,417,435 | 5/1995 | Peretz . | |
| 5,690,330 | 11/1997 | Ozawa | 273/108.56 |

*Primary Examiner*—Sebastiano Passaniti
*Attorney, Agent, or Firm*—Christensen O'Connor Johnson & Kindness PLLC

[57] ABSTRACT

A game apparatus (20) for propelling a ball (37) towards a target. The game apparatus (20) includes a housing (22), a launching mechanism (32) mounted in a first end portion of the housing, and a rotary-translating target (44) mounted on a second end portion of the housing. The launching mechanism includes a catapult lever (34) biased away from the housing by a spring (42). A rotatable cup (36) for carrying the ball is rotatably carried on the catapult lever. A linkage arm (43) is pivotally connected between the rotatable cup and a mounting post (58). Depression of the catapult lever causes rotation of the rotatable cup and received ball, while release of the catapult lever causes the rotatable cup to impart an axial spin to the ball (37) as it is propelled toward the target. The target moves along a circular path during game play.

24 Claims, 6 Drawing Sheets

BALL GAME APPARATUS WITH SPIN IMPARTING CATAPULT

FIELD OF THE INVENTION

The present invention relates to a game apparatus, and more particularly to a game apparatus for propelling a game projectile so that the game projectile spins as it advances toward a translating target.

BACKGROUND OF THE INVENTION

Game apparatus configured to simulate the play of sports games, and test a player's skill and accuracy, are well known and popular. One type of apparatus simulates the playing of a basketball game and requires the player to launch a ball into a basket. Such a table-top basketball game is disclosed by U.S. Pat. No. 2,735,682 to Sweet. The game is played by two players, each flipping balls with a lever toward an opposing basket. The location of the opposing basket may be changed between games by adjusting a screw that secures the basket in a selected position relative to the shooting lever. However, the disclosed game apparatus does not provide for a continuous or automated adjustment of the distance between the ball launching lever and the opposing basket during the play of the game.

Another conventional apparatus is disclosed by U.S. Pat. No. 4,496,160 to Wichinsky et al. The disclosed arcade-style game provides a number of laterally spaced coin slots into which a coin may be inserted. The inserted coin is then hurled towards a backboard containing a number of baskets. The backboard includes one basket that is mounted to automatically translate from side to side during the course of the game. While this transverse translation of the basket does cause a user to choose the optimum coin slot into which to place a coin, it does not affect a change in the distance between the coin launching platform and the basket.

Conventional game apparatus of the type noted above present several functional limitations. First, they do not provide a continuously changing distance between a projectile propeller and a target. As such, they do not adequately simulate the play of actual sports games which, to a great extent, involve relative movement between a projectile source and a target. Because playing conventional game apparatus obviates the need to gage moving targets to direct projectiles thereto, the hand-eye coordination and other adjustment skills required for live sports are not utilized. Conventional apparatus have the additional disadvantage of becoming readily mastered due to their relatively simple, static game design. As a result, use of these games can quickly become mundane and unchallenging.

U.S. Pat. No. 5,150,898 to Hochberg et al. discloses a game apparatus which addresses some of these shortcomings by incorporating many of the dynamics characterized in playing live sports games. More specifically, the game includes a catapult propeller which projects a ball towards a longitudinally moving basket. Because the distance between the catapult and the basket varies throughout play of the game, a player must gage the distance between the ball and the basket continuously and adjust the trajectory of the ball according to its instant of separation from the basket. In this way, the basketball-style game more realistically imitates the action of live sports thus providing more excitement and challenge during play. However, movement of the basket occurs only along a single, longitudinal axis, and thus does not fully mimic actual court play.

SUMMARY OF THE INVENTION

The present invention provides a game apparatus for propelling a game projectile towards a target. The invention includes a housing having a first end portion and a second end portion. A propeller mounted adjacent the first end portion propels the game projectile towards the target. A rotatable holder mounted on the propeller carries the game projectile. A rotation linkage coupled to the rotatable holder imparts rotation to the rotatable holder as it carries the game projectile. The game projectile is thus propelled towards the target with a spinning motion as it leaves the propeller.

In a preferred embodiment of the present invention, the game apparatus is configured as a table top football game. The game includes a catapult lever mounted on a base of the first end portion of the housing. A spring biases the catapult lever away from the base. A rotatable cup having a keyed surface therein is rotatably secured within an aperture defined in the catapult lever. The rotatable cup receives a ball having a keyed surface which securely mates with the keyed surface of the rotatable cup. The rotatable cup is pivotally connected to one end of a linkage arm. The other end of the linkage arm is pivotally connected to the base. As the catapult lever is depressed, the linkage arm causes the rotatable cup to rotate in a first direction. As the catapult lever is released, the linkage arm causes the rotatable cup to rotate in a second direction to return to its original position. This rotation of the rotatable cup imparts an axial spin to the ball. Accordingly, when the depressed catapult lever is released, returning under spring force to its original position, a spin is imparted from the rotatable cup to the ball. As the ball emerges from the rotatable cup and is propelled toward the target, it spins on its axis to simulate the action of actual football game play.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
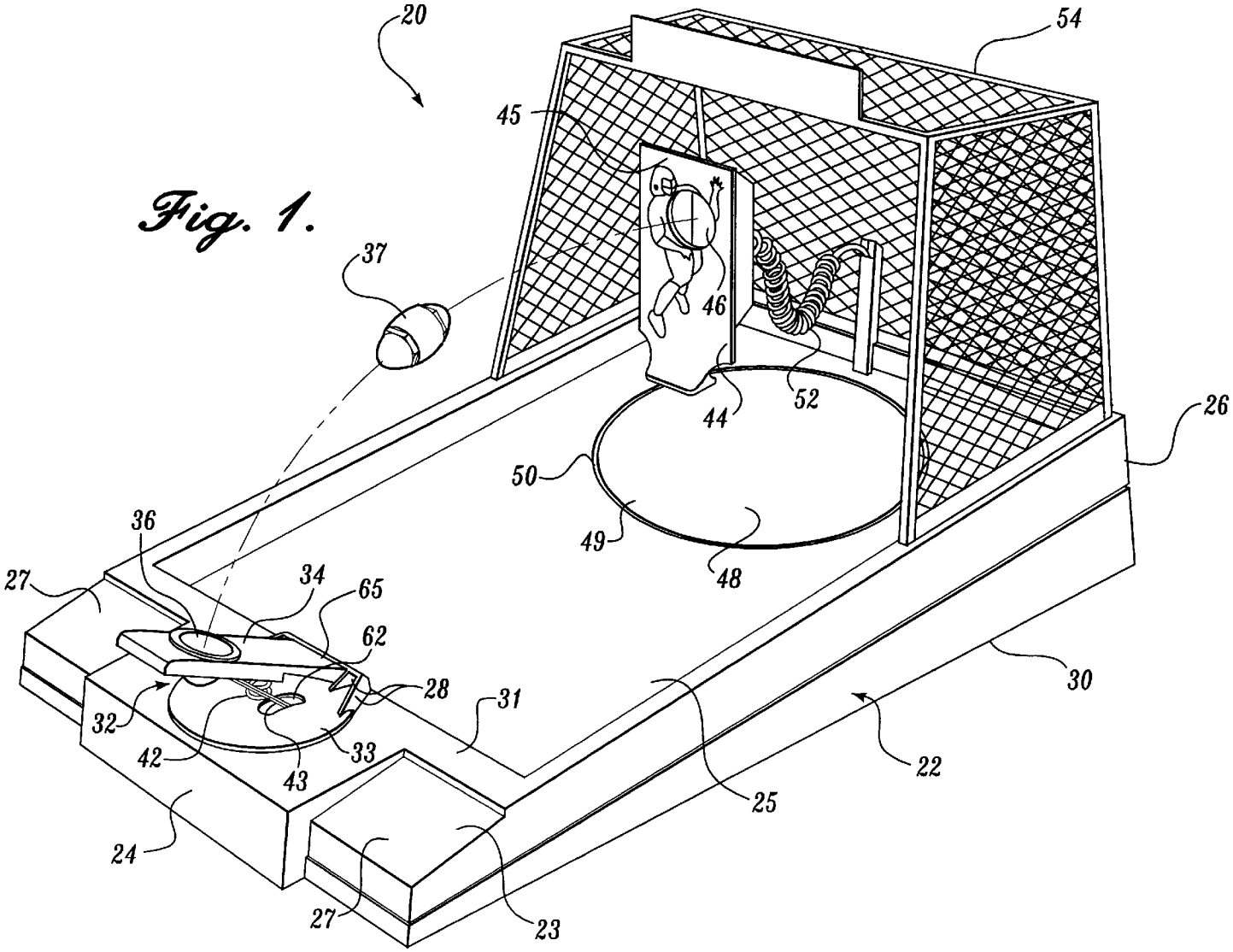
FIG. 1 shows a pictorial view of a game apparatus constructed in accordance with the present invention.

A preferred embodiment of a game apparatus 20 constructed in accordance with the present invention is illustrated in FIG. 1. The preferred embodiment of the invention illustrated is configured as a table-top game apparatus simulating aspects of actual football play. The game apparatus 20 includes a launching mechanism 32 located at a front end portion 24 of a base constructed as a housing 22. A target 44 is mounted at a back end portion 26 of the housing 22. The launching mechanism 32 includes a catapult lever 34 which carries a rotatable cup 36 that is adapted to carry a ball 37. During play, the rotatable cup 36 imparts axial spin rotation to the ball 37 as the ball 37 is propelled toward the target 44.

The housing 22 of the game apparatus 20 is generally formed as an inverted hollow shell. The top surface of the front end portion 24 of the housing 22 includes a forward surface 23 on which the launching mechanism is centrally mounted. A deck surface 25 extends from the forward surface 23 to the back end portion 26. The forward surface 23 includes two declining planar portions 27 separated by a central raised platform 31. As will be discussed in more detail below, the platform 31 carries the launching mechanism 32. The deck surface 25 of the housing 22 defines a raised perimeter edge and defines a ball return trough that begins at the back end portion 26 and slopes downwardly toward the front end portion 24. A bottom surface 30 of the housing contacts a table or other platform on which the game apparatus 20 rests.

Figure 5:
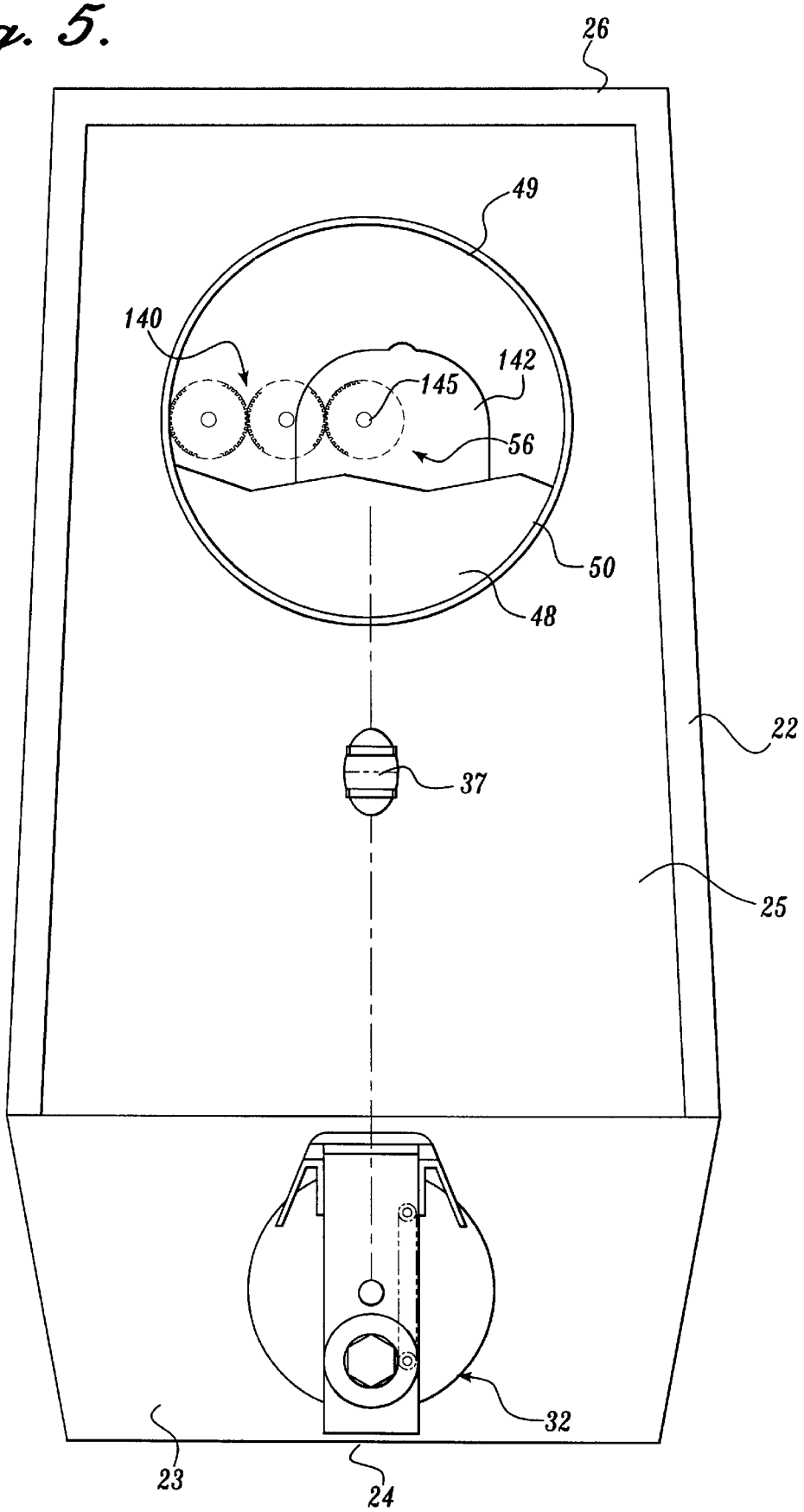
FIG. 5 shows a top elevation view of the game apparatus of FIG. 1 with a portion of a mechanism housing removed to show the target translation mechanism.

The target 44 is mounted at the back end portion 26 of the housing 22 and is disposed substantially vertically. The upper end of the target 44 defines an aperture 46 therethrough. The target 44 preferably includes a depiction of a football player 45 positioned to receive the propelled ball 37 through the opening 46. The target 44 is mounted upright on the perimeter of a disk-shaped translation mechanism cover 48, which is mounted within a recess 49 formed within the deck surface 25. The circular perimeter 50 of the mechanism cover 48 corresponds to the path of travel of the target 44 as it is caused to move by a translation mechanism 56 (FIG. 5). The target 44 includes a switch (not shown) which detects the passage of a ball through the opening 46 and communicates this information to a CPU 144 (FIG. 6) for display purposes. A screen structure 54 projects upwardly from the perimeter edges of the back end portion of the housing 22. The screen structure 54 acts as an enclosure to contain balls propelled to the vicinity of the game apparatus 20 which miss the target 44.

As described above and illustrated in FIG. 2, the launching mechanism 32 is positioned centrally on the platform 31 at the front end portion 24 of the housing 22. The launching mechanism includes a rotatable base 33; a catapult lever 34 which is hingedly coupled to the base 33; a spring 42 which biases the catapult lever 34 away from the base 33; a spin imparting ball cup 36 carried on the free end of the catapult lever 34; and a linkage arm 43 coupling the ball cup 36 to the base 33. Each of these components will now be described in more detail.

The base 33 of the launching mechanism 34 is mounted on the platform 31 to rotate about its central axis, as selectively positioned by a game player. The base 33 has an outer edge which is substantially circular. The base 33 has a slightly convex top surface which is raised from a plane defined by the top surface of the platform 31. The base 33 includes a slot 62 extending tangentially to a point offset radially from the central axis of the base 33. The slot 62 receives the linkage arm 43 therethrough. A cylindrical spring cavity 60 is formed in the top surface of the base 33 to receive a first end of the spring 42.

The base 33 also includes a catapult hinge support 65 including a pivot bar 160 that is elevated above the rear side of the base 33 by flanges 28. The flanges 28 project rearwardly and upwardly from the rear side of the upper surface of the base 33, in spaced parallel disposition. The cylindrical pivot bar 160 is formed transversely across the ends of the flanges 28, at an elevation spaced above the base 33. A skirt section 162 spans across the rear ends of the flanges 28 and the bar 160. The bar 160 receives a transverse arcuate lower end of the catapult lever 34, as shall be described subsequently.

The base 33 also includes a mounting post 58 projecting downwardly from its lower surface for mounting of the linkage arm 43, as shall be described subsequently. Preferably, the base 33 is formed as a single piece, unitary molding including the catapult hinge support 65 and mounting post 58.

The catapult lever 34 has an upwardly projecting front end 132 and a hinge forming back end 134. A U-shaped trough 154 is formed transversely across the back edge of the back end 134. The U-shaped trough 154 is positioned below and receives the bar 160 of the support 65 to form a pivot hinge. The catapult lever 34 thus pivots about the bar 160, as constrained by the flanges 28 of the support 65.

A transversely centered opening 150 is formed through the catapult lever 34 adjacent the front end 132. The opening 150 is dimensioned to receive the rotatable cup 36. The rotatable cup 36 is assembled through the top surface of the catapult lever 34 and is secured in place by a spinner/retainer 164, as will be described subsequently. A cylindrical spring holder 136 is formed on the lower surface of the catapult lever 34, projecting orthogonally downward from a point midway between the opening 150 and the trough 154. The cylindrical holder 136 receives the upper end of the spring 42, the opposite end of the spring being mounted within the recess 60 of the base 33. The catapult lever 34 is thus biased away from the base 33 and the housing 22 of the game apparatus 20.

Figure 2:
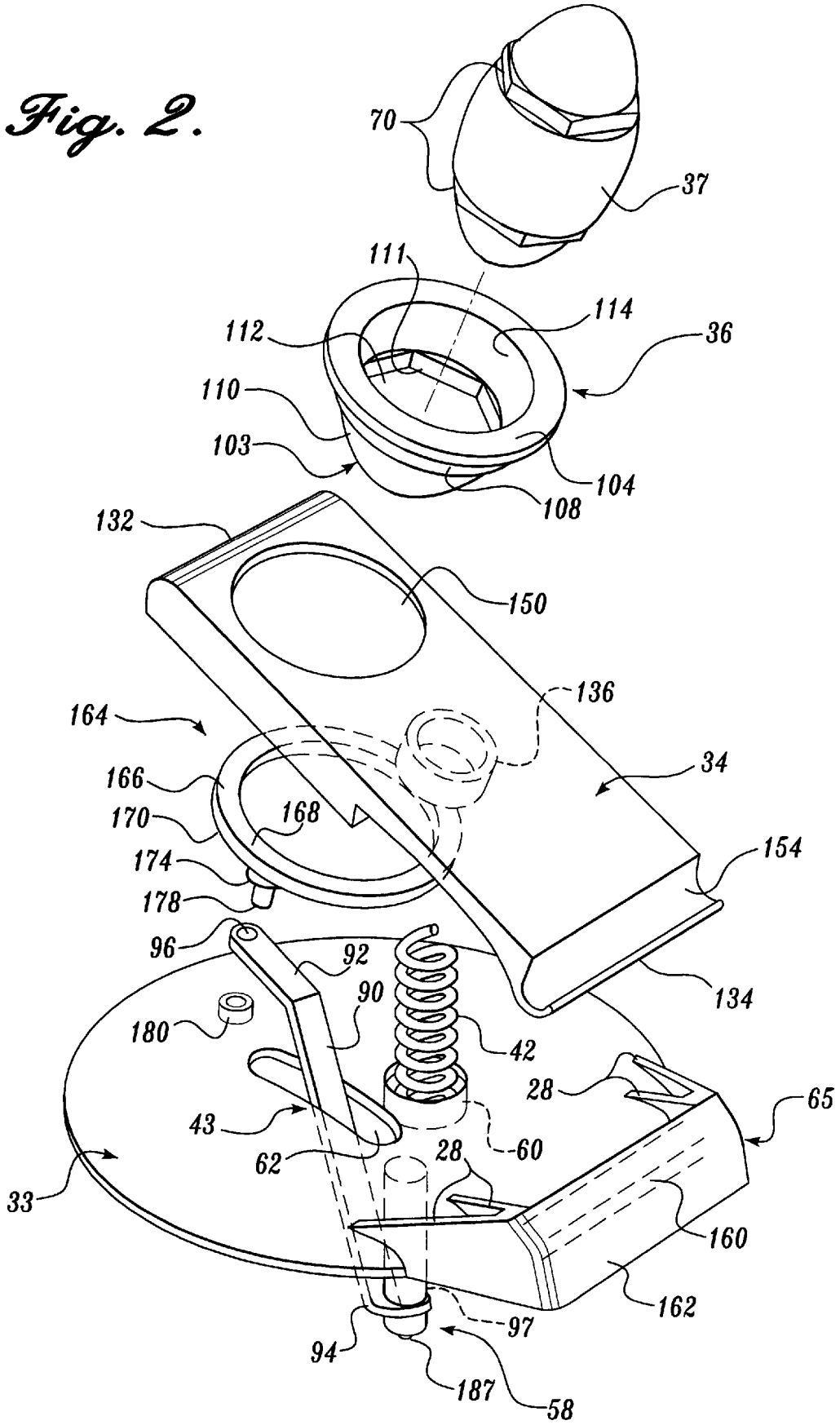
FIG. 2 shows an exploded view of a launching mechanism of the game apparatus of FIG. 1.

The rotatable cup 36 is securely mounted through the catapult lever 34 adjacent the front end 132. Referring still to FIG. 2, the rotatable cup 36 has a concave center portion 103 which defines an opening 114 and that is bordered by an annular flange 104. The exterior of the center portion 103 defines a cylindrical mounting portion 108 below the annular flange 104. The annular flange 104 has a larger outer diameter than does the mounting portion 108, which in turn has a larger outer diameter than does the center portion 103. The outer surface 110 of the center portion 103 of the rotatable cup 36 extends downwardly from the mounting portion 108 to define an elliptical contour. Like the outer surface 110, the inner surface 112 is generally elliptical. However, an annular keyed portion 111 of the inner surface 112 is hexagonally configured (as viewed in transverse cross section) to snugly receive a correspondingly keyed portion of the ball 37.

The annular keyed portion 111 is coaxially aligned with the central longitudinal axis of the center portion 103 of the rotatable cup 36. A plane defined by the hexagonal cross section of the keyed portion 111 is orthogonal to the central longitudinal axis of the rotatable cup 36.

As stated above, the ball 37 is configured to securely mate with the inner surface 112 of the rotatable cup 36. The ball 37 thus has an exterior surface configuration that corresponds to the interior surface configuration of the cup 36. The ball 37 generally has the shape of a football having a longitudinal axis and circular cross sections. However, an annular, hexagonal keyed portion 70 is formed about the outer surface of the ball 37 adjacent each longitudinal end of the ball 37. The two keyed portions 70, which are hexagonal when viewed endwise, are positioned symmetrically from one another about a central transverse plane of the ball 37. Each keyed portion 70 of the ball 37 is configured to provide a snug fit with the keyed portion 111 of the rotatable cup 36 when the corresponding end of the ball 37 is received within the cup 36. When so received, the longitudinal axes of the ball 37 and cup 36 are aligned, with the keyed portions 70 and 111 engaged to prevent rotation of the ball 37 relative to the cup 36.

Figure 3:
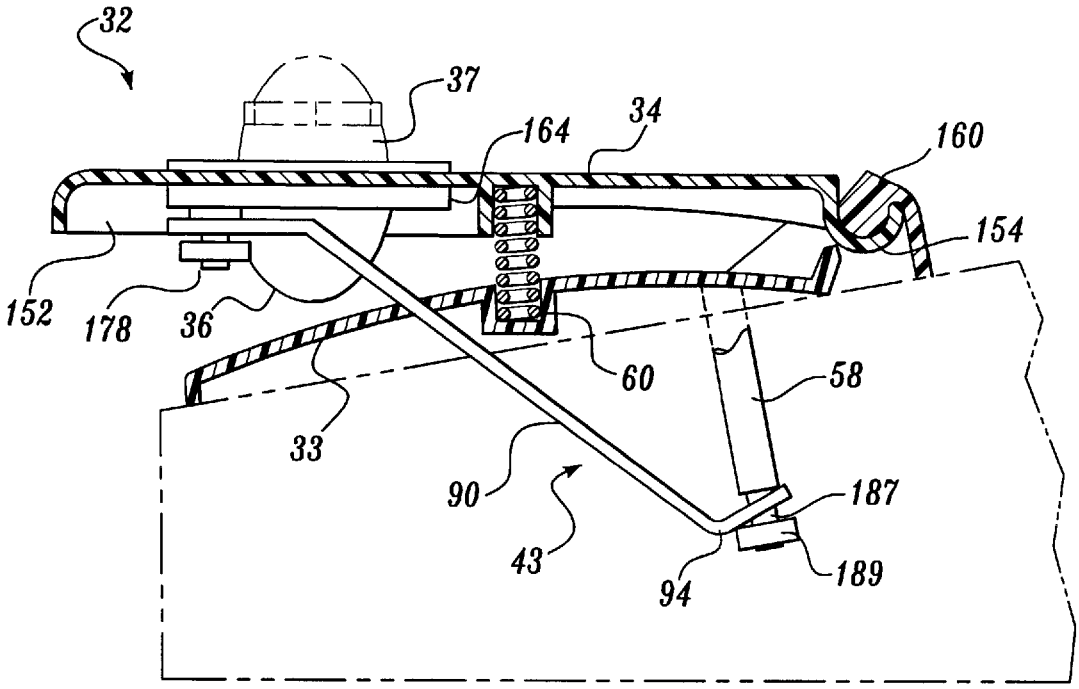
FIG. 3 shows a side view of the launching mechanism of the game apparatus of FIG. 1 when a catapult lever is depressed, with the catapult and base being shown in longitudinal cross section.

As shown in FIGS. 2 and 3, the rotatable cup 36 is retained within the opening 150 of the catapult lever 34 by spinner/retainer 164, which is press-fit mounted on the mounting portion 108 of the cup 36 below the bottom surface of the catapult lever 34. The spinner/retainer 164 defines an annular body 166 and an integral stud 178 projecting therefrom. The annular body 166 has an inner diameter dimensioned to be securely press fit onto the mounting portion 108 of the rotatable cup 36, capturing the catapult lever 34 therebetween. The cylindrical stud 178 projects downwardly away from the bottom surface of the body 166, and as such is radially offset from the center of the rotatable cup 36 and spinner/retainer 164. The stud 178 has an enlarged cylindrical base 174. As will be discussed below, the length of the stud 178 is sufficient to allow the mounting of a linkage arm 43 and a nut 180 thereon.

The linkage arm 43 includes an elongate, central shaft portion 90, upper angled end 92 and a lower angled end 94 (FIGS. 2 and 3). The upper angled end 92 forms an obtuse angle with the longitudinal axis of the central shaft portion 90. The lower angled end 94 is oriented substantially perpendicular to the longitudinal axis of the central shaft portion 90. The upper angled end 92 and lower angled end 94 extend oppositely of each other. An aperture 96 is formed centrally through the distal tip of the upper angled end 92. Another aperture 97 is formed centrally through the lower angled end 94.

The aperture 96 of the upper angled end 92 of the linkage arm 43 rotatably receives the stud 178 of the spinner/retainer 164. The linkage arm 43 is securely and pivotally held on the stud 178 of the spinner/retainer 164 by a press-fit nut 180.

When so connected, the central shaft portion 94 of the linkage arm 43 passes through the slot 62 formed in the base 33. The opposite lower angled end 98 of the linkage arm 43 is likewise rotatably connected to the mounting post 58 which projects from the underside of the base 33. The mounting post 58 is cylindrical and projects downwardly from the bottom side of the base 33, as shown in FIG. 3.

The mounting post 58 includes a reduced diameter mounting portion 187 formed on its lower tip. The mounting portion 187 is rotatably received within the aperture 97 of the lower angled end 94 of the linkage arm 43. A nut 189 is then press-fit onto the mounting portion 187 to securely and pivotally connect the linkage arm 43 to the mounting post 58.

The linkage arm 43 provides for rotation of the rotatable cup 36 relative to the base 33 upon depression and release of the lever 34, as shall now be described. During play of the game apparatus 20, the rotatable cup 36 receives the ball 37 so that a keyed portion 70 of the ball 37 snugly mates with the keyed portion 111 of the rotatable cup 36. When the ball 37 is to be launched toward the target 44, the base 33 is selectively rotated within the housing 22 to a desired radial orientation. The catapult lever 34 is selectively depressed to compress the spring 42 a desired extent for a corresponding desired trajectory of the ball 37. During depression of the catapult lever 34, the rotatable cup 36, and thus the ball 37 secured therein, rotates as the pivot point connection of the spinner/retainer 164 to the linkage arm 43 moves relative to the pivot point connection of the mounting post 58 to the linkage arm 43.

Figure 4:
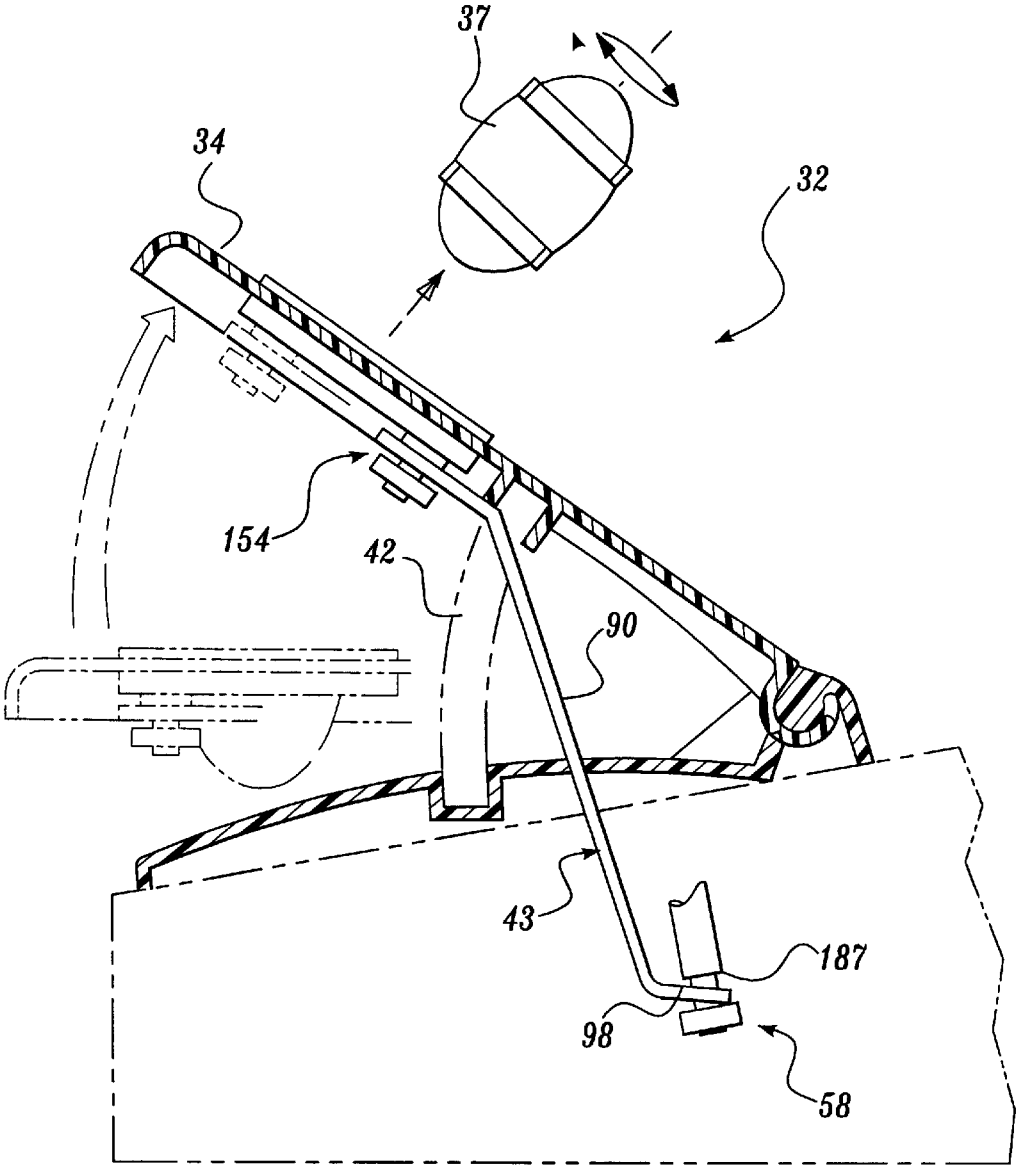
FIG. 4 shows a side view of the launching mechanism of the game apparatus of FIG. 1 when the catapult lever is released, with the catapult and base being shown in longitudinal cross section.

FIG. 3 illustrates the catapult lever 34 in the fully depressed position. The compressed spring biases the catapult lever 34 upwardly. The depression of the catapult lever 34 has also caused the linkage arm 43 to move downwardly and to in turn rotate the rotatable cup 36 in a clockwise direction, as viewed from above. As shown in FIG. 4, when the catapult lever 34 is released, the spring 42 causes the catapult lever 34 to move rapidly in an upward direction. The movement of the catapult lever 34 in an upward direction causes the linkage arm 43 to rotate the rotatable cup 36 in the opposite, i.e., counterclockwise, direction (as viewed from above). As the catapult lever 34 moves upwardly, the ball emerges from the rotatable cup with a counterclockwise spiral motion imparted by the rotation of the rotatable cup.

Figure 6:
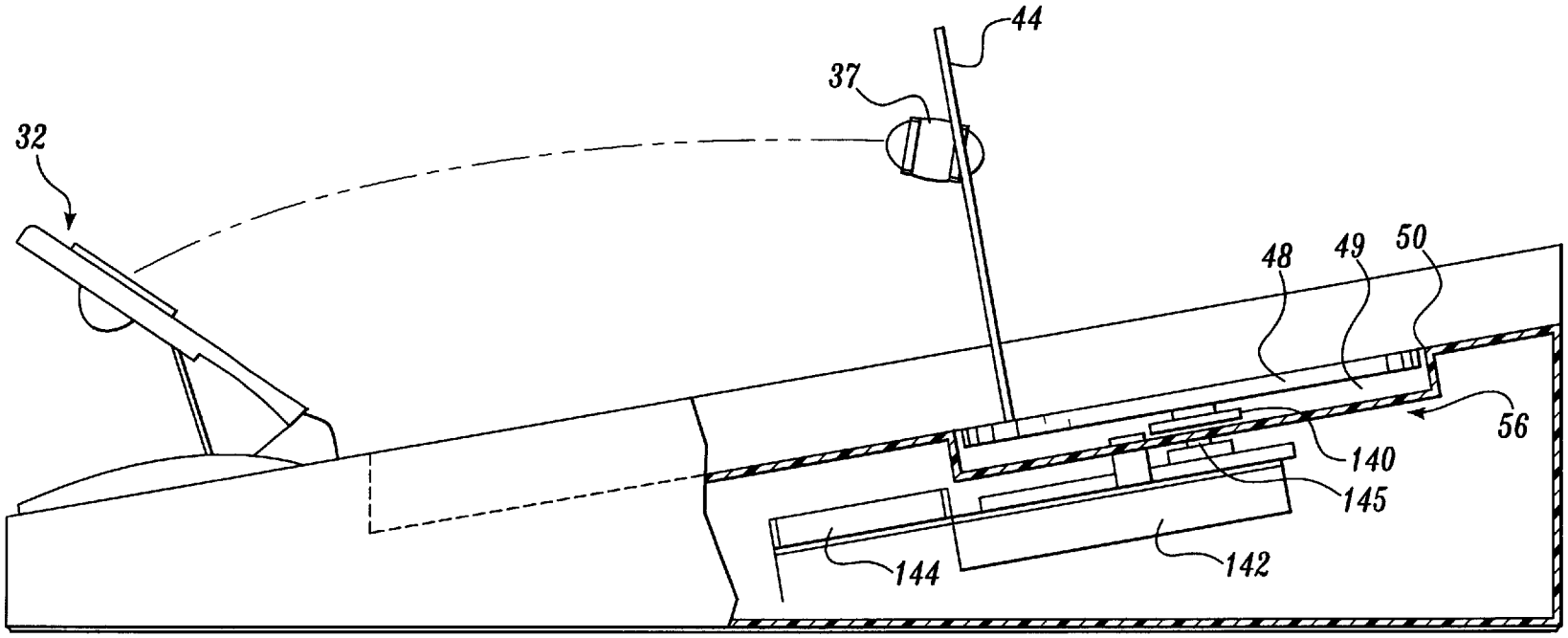
FIG. 6 shows a side view of the game apparatus of FIG. 1 with a portion of the housing removed to show the target translation mechanism.

As stated above, the target 44 moves automatically during game play as a result of the translation mechanism 56. The translation mechanism 56 includes a drive motor 142, a planetary gear transmission 140, and a central processing unit 144, as illustrated in FIGS. 5 and 6. The translation mechanism 56 is mounted within the housing 22 adjacent the back end portion 26. The cover plate 48 is mounted within the recess 49 and axially on the drive shaft 145 of the motor 142, and thus causes rotation of the cover plate 48 and the target 44 carried thereon. The target 44 thus scribes a circular path in a plane defined by the housing 22. The drive shaft 145 of the motor 142 also drives the planetary gear transmission 140 which is carried on the underside of the cover plate 48. The gear transmission 140 causes the target 44 to always face forwardly towards the launching mechanism 32 as the target 44 travels along the circular path 50. The motor 142 is reversible, with its speed, direction of rotation, and duration of rotation controlled by the CPU 144. Movement of the target 44 can thus vary during play, reversing randomly in direction during operation, or pausing at intervals, as determined by programming of the CPU 144. The combination of the spinning ball 37 and rotary-translating target 44 of the present invention provides for varied and realistic game action.

Numerous game variations can be played on a game apparatus constructed in accordance with the present invention. For example, although the preferred embodiment of the game apparatus 20 has been described as a miniaturized football game, other types of game apparatus may be constructed in accordance with the present invention to resemble other sports games. For example, a golf game apparatus could be constructed in which a propelling device operable by a player strikes a golf ball toward a golf cup target. The spinning of the golf ball, as it is propelled, would provide a realistic simulation of actual golf play. In addition, the present invention could be constructed to simulate basketball play. In this regard, a player could propel a basketball toward a basket target so that the basketball spins in the air, as is sometimes true in actual basketball game play, when the ball is shot towards a basket. A soccer game is also possible within the scope of the present invention.

The ball 37 and the rotatable cup 36 embodied in the game apparatus 20 described above are each configured to have keyed portions. In cross-section, the keyed portions 70, 111 are hexagonally configured. However, it should be readily apparent that the keyed portions can have other shapes. For example, the ball 37 and the rotatable cup 36 could each have keyed portions with cross sections forming pentagons or cross shapes, for example. Likewise, other types of translating targets, or a stationary target, could be used with the catapult launch of the present invention to provide some of the benefits of the present invention.

The preferred embodiment has been disclosed and illustrated in terms of a table top game. The present invention could be readily adapted for games of differing scale, such as an arcade or life size game apparatus.

The present invention has been described in relation to a preferred embodiment and several variations. One of ordinary skill after reading the foregoing specification will be able to effect various other changes, alterations, and substitutions of equivalents without departing from the broad concepts disclosed. It is therefore intended that the during game play scope of Letters Patent granted hereon be limited only by the definition contained in the appended claims and equivalents thereof, and not by limitations of the embodiments described thereof.

The embodiments of the invention in which an exclusive property or privilege is claimed are defined as follows:

1. A game apparatus for propelling a game projectile towards a target, comprising:

(a) a base having a first end portion and a second end portion;

(b) a catapult lever mounted on the first end portion and selectively depressalble and releasable to propel the game projectile towards the second end portion of the base;

(c) a rotatable holder carried on and extending through the catapult lever for carrying and at least partially circumscribing the game projectile; and (d) a linkage coupling the rotatable holder to the base for rotation of said rotatable holder during release of the catapult lever to impart a spinning motion to the game projectile as the game projectile is propelled from the catapult lever.

2. The game apparatus of claim 1, wherein said rotatable holder includes a keyed surface portion for engaging a mating keyed surface portion on the game projectile when the game projectile is carried by said rotatable holder.

3. The game apparatus of claim 1, wherein said catapult lever is hingedly connected to and projecting outwardly from said base, and is depressable towards said base, said rotatable holder being rotatably mounted in a projecting end of said catapult, further comprising means for biasing said catapult away from said base.

4. The game apparatus of claim 1, further comprising a catapult base rotatably mounted on the base, the catapult lever being mounted in the catapult base to permit rotation of the catapult lever relative to the second end portion of the base.

5. The game apparatus of claim 4, wherein said linkage has a first end pivotally connected to said catapult base and a second end pivotally connected to said rotatable holder at a point radially offset from an axis of rotation of said rotatable holder.

6. The game apparatus of claim 1, wherein said linkage has a first end pivotally connected to said base and a second end pivotally connected to said rotatable holder at a point radially offset from an axis of rotation of said rotatable holder.

7. The game apparatus of claim 1, wherein said rotatable holder rotates in a first direction as said catapult lever is depressed and rotates in a second direction as said catapult lever is released.

8. The game apparatus of claim 1, further comprising an engaging surface formed on the rotatable holder that is engageable with a corresponding surface formed on the game projectile to prevent rotation of the received game projectile relative to the rotatable holder during rotation of the rotatable holder.

9. The game apparatus of claim 1, further comprising a target mounted on the second end portion of the housing.

10. The game apparatus of claim 9, further comprising means for automatically imparting motion to the target relative to the catapult lever during operation of the game.

11. The game apparatus of claim 10, wherein said means for imparting motion causes the target to move along a curvilinear path.

12. The game apparatus of claim 11, wherein said means for imparting motion causes the target to move along a curvilinear path in a horizontal plane defined by the base.

13. The game apparatus of claim 10, wherein said means for imparting motion is operable to move the target in a first forward rotation direction and in a second reverse rotation direction.

14. The game apparatus of claim 13, wherein said means for imparting motion intermittently reverses motion of the target.

15. A game apparatus for propelling a game projectile towards a target, comprising:

a base having a first end portion and a second end portion;

a projectile launcher mounted on the first end portion of the base for at least partiality circumscribing and propelling a received game projectile towards the second end portion of the base; and means coupled to the projectile launcher for imparting spinning motion to the game projectile as it is propelled from the projectile launcher.

16. The game apparatus of claim 15, further comprising a target mounted on the second end portion of the base.

17. The game apparatus of claim 16, further comprising means for automatically moving the target relative to the projectile launcher during operation of the game.

18. A game apparatus for propelling a game projectile towards a target, comprising:

a base;

a catapult mounted on the base;

a projectile holder rotatably carried on the catapult lever for receiving and at least partially circumscribing a projectile, the projectile holder having a central axis that is aligned with a central axis of the received projectile;

means for rapidly advancing the catapult away from the base; and means for rotating the projectile holder during advancement of the catapult so that the projectile is propelled from the catapult with an axial spinning motion.

19. A game apparatus for propelling a game projectile towards a target, comprising:

(a) a base having a first end portion and a second end portion;

(b) a catapult lever mounted on the first end portion and selectively depressable and releasable to propel the game projectile towards the second end portion of the base;

(c) a rotatable holder carried on the catapult lever for carrying the game projectile; and (d) a linkage coupling the rotatable holder to the base for rotation of said rotatable holder during release of the catapult lever to impart a spinning motion to the game projectile as the game projectile is propelled from the catapult lever, wherein said rotatable holder includes a keyed surface portion for engaging a mating keyed surface portion on the game projectile when the game projectile is carried by said rotatable holder.

20. A game apparatus for propelling a game projectile towards a target, comprising:

(a) a base having a first end portion and a second end portion;

(b) a catapult lever mounted on the first end portion and selectively depressalble and releasable to propel the game projectile towards the second end portion of the base;

(c) a rotatable holder carried on the catapult lever for carrying the game projectile;

(d) a linkage coupling the rotatable holder to the base for rotation of said rotatable holder during release of the catapult lever to impart a spinning motion to the game projectile as the game projectile is propelled from the catapult lever; and (e) a catapult base rotatably mounted on the base, the catapult lever being mounted in the catapult base to permit rotation of the catapult lever relative to the second end portion of the base.

21. A game apparatus for propelling a game projectile towards a target, comprising:

(a) a base having a first end portion and a second end portion;

(b) a catapult lever mounted on the first end portion and selectively depressable and releasable to propel the game projectile towards the second end portion of the base;

(c) a rotatable holder carried on the catapult lever for carrying the game projectile; and (d) a linkage coupling the rotatable holder to the base for rotation of said rotatable holder during release of the catapult lever to impart a spinning motion to the game projectile as the game projectile is propelled from the catapult lever, wherein said linkage has a first end pivotally connected to said base and a second end pivotally connected to said rotatable holder at a point radially offset from an axis of rotation of said rotatable holder.

22. A game apparatus for propelling a game projectile towards a target, comprising:

(a) a base having a first end portion and a second end portion; (b) a catapult lever mounted on the first end portion and selectively depressalble and releasable to propel the game projectile towards the second end portion of the base;

(c) a rotatable holder carried on the catapult lever for carrying the game projectile; and (d) a linkage coupling the rotatable holder to the base for rotation of said rotatable holder during release of the catapult lever to impart a spinning motion to the game projectile as the game projectile is propelled from the catapult lever, wherein said rotatable holder rotates in a first direction as said catapult lever is depressed and rotates in a second direction as said catapult lever is released.

23. A game apparatus for propelling a game projectile towards a target, comprising:

(a) a base having a first end portion and a second end portion;

(b) a catapult lever mounted on the first end portion and selectively depressable and releasable to propel the game projectile towards the second end portion of the base;

(c) a rotatable holder carried on the catapult lever for carrying the game projectile;

(d) a linkage coupling the rotatable holder to the base for rotation of said rotatable holder during release of the catapult lever to impart a spinning motion to the game projectile as the game projectile is propelled from the catapult lever; and (e) an engaging surface formed on the rotatable holder that is engageable with a corresponding surface formed on the game projectile to prevent rotation of the received game projectile relative to the rotatable holder during rotation of the rotatable holder.

24. A game apparatus for propelling a game projectile towards a target, comprising:

a base having a first end portion and a second end portion;

a projectile launcher mounted on the first end portion of the base for propelling a received game projectile towards the second end portion of the base;

means coupled to the projectile launcher for imparting spinning motion to the game projectile as it is propelled from the projectile launcher;

a target mounted on the second end portion of the base; and means for automatically moving the target relative to the projectile launcher during operation of the game.

* * * * *

UNITED STATES PATENT AND TRADEMARK OFFICE

CERTIFICATE OF CORRECTION

PATENT NO. : 5,851,012
DATED : December 22, 1998
INVENTOR(S) : M. Langieri, Jr. et al.

It is certified that error appears in the above-indentified patent and that said Letters Patent is hereby corrected as shown below:

| COLUMN | LINE | |
|---|---|---|
| 7 (Claim 1, | 22 line 6) | "depressalble" should read --depressable-- |
| 8 (Claim 15, | 23 line 5) | "partiality" should read --partially-- |
| 9 (Claim 20, | 6 line 6) | "depressalble" should read --depressable-- |
| 9 (Claim 22, | 44 line 4) | before "(b)" insert a return |
| 9 (Claim 22, | 45 line 3) | "depressalble" should read --depressable-- |

Signed and Sealed this

Eighteenth Day of May, 1999

*Attest:*

*Attesting Officer*

Q. TODD DICKINSON

*Acting Commissioner of Patents and Trademarks*